United States Patent [19]

Palmer

[11] 3,999,316

[45] Dec. 28, 1976

[54] LAWN SWEEPER ATTACHMENT FOR SNOW BLOWER

[76] Inventor: Raymond E. Palmer, 1735 Denfield Ave., Benson, Minn. 56215

[22] Filed: June 30, 1975

[21] Appl. No.: 591,430

[52] U.S. Cl. ..... 37/43 L; 56/202; 172/112; 15/83

[51] Int. Cl.[2] ..... E01H 5/00; A01D 35/22

[58] Field of Search ..... 37/43 R, 43 D, 43 E, 37/43 L, DIG. 3; 56/14.4, 328, 202, 377; 172/112; 15/83, 79

[56] References Cited

UNITED STATES PATENTS

| | | | |
|---|---|---|---|
| 2,214,702 | 9/1940 | Seaman | 172/112 X |
| 2,558,822 | 7/1951 | Claus | 172/112 X |
| 2,617,347 | 11/1952 | Provost | 56/202 X |
| 2,675,660 | 4/1954 | Barnard | 37/43 L |
| 2,809,389 | 10/1957 | Collins et al. | 56/202 X |
| 2,815,590 | 12/1957 | Fiacco | 37/43 R |
| 2,901,879 | 9/1959 | Jones | 56/328 |
| 2,964,896 | 12/1960 | Finocchiaro | 15/83 X |
| 3,024,587 | 3/1962 | Warnke | 56/14.4 |
| 3,131,491 | 5/1964 | Durrschmidt | 37/43 L |
| 3,190,672 | 6/1965 | Swanson et al. | 15/83 X |
| 3,233,394 | 2/1966 | Lundell | 56/14.4 X |
| 3,340,626 | 9/1967 | Konucik | 37/43 R |
| 3,444,583 | 5/1969 | Laurel | 15/83 |
| 3,673,715 | 7/1972 | Lines | 37/43 L |
| 3,695,716 | 10/1972 | Meyer | 37/43 E |
| 3,726,069 | 4/1973 | Cope | 56/202 |
| 3,748,675 | 7/1973 | Schultz | 37/43 L X |
| 3,758,967 | 9/1973 | Thompson | 37/43 E |
| 3,849,824 | 11/1974 | Doering | 15/83 |
| 3,859,685 | 1/1975 | Doering et al. | 15/83 |

FOREIGN PATENTS OR APPLICATIONS

| | | | |
|---|---|---|---|
| 2,145,715 | 3/1972 | Germany | 15/83 |

*Primary Examiner*—E. H. Eickholt
*Attorney, Agent, or Firm*—Dugger, Johnson & Westman

[57] ABSTRACT

An attachment for fitting onto existing snow blowers commonly used by home owners which converts the snow blower to a lawn sweeper with a minimum of expense and time in change over, and thus provides means for utilizing the power source of the snow blower during summer months to get dual usage from the unit.

6 Claims, 4 Drawing Figures

LAWN SWEEPER ATTACHMENT FOR SNOW BLOWER

BACKGROUND OF THE INVENTION

1. Field of the Invention

The present invention relates to attachments for converting snow blowers into a multiple purpose usage, such as for lawn sweepers.

2. Prior Art

In the prior art, the concept of converting a snow blower to a rake or sweeper attachment which involves a substantial modification of existing portions of the snow blower is shown in U.S. Pat. No. 3,673,715. In this patent, sweeping tines are clamped directly to the rotor shaft of the blower after the shaft has had adapters fastened to it. While this type of arrangement may operate satisfactorily for lawn sweeping, it does require substantial modification of the snow blower, and it would appear that some of the attachment members may interfere with efficient operation of the unit as a snow blower.

A combination yard maintenance apparatus is shown in U.S. Pat. No. 3,758,967, which requires interchanging of parts to convert it from one usage to another. It does include a bagging attachment for collecting debris, but appears to have quite complex mechanism for carrying out the intent of the unit.

Another unit having a bagging attachment for collecting debris or leaves and the like is shown in U.S. Pat. No. 3,859,685.

SUMMARY OF THE INVENTION

The present invention relates to a simple, low cost attachment for converting a self-powered home owner's size snow blower into a lawn raking unit. The attachment comprises the use of a rotary raking device mounted in a framework that moves material directly into the housing for the conventional rotor of the snow blower, and means for supporting a bagging attachment adjacent to the discharge spout of the snow blower, if desired. Suitable drives can be attached directly to the ends of the snow blower auger for simplifying the driving arrangement, and in order to insure adequate collection of leaves, grass and debris being swept, the bottom portion of the rotor housing is closed with a plate or pan member.

The unit has openable closure members that cover the rotor of the snow blower, and also the rotary raking bar, which members can be pivoted to permit easy access to the snow blower rotor and rotary tool that directs material to the blower rotor to permit cleaning, if plugged, and easy maintenance.

As shown, the attachment includes means for supporting the front end thereof in a spaced relationship to the ground so that the raking bar does not dig into the ground accidently.

The advantages of such a system are readily apparent. In areas where snow blowers are utilized, summer finds the snow blower becoming a burden in that it has to be stored or put away for the summer months. The capital investment in the snow blower includes generally an internal combustion engine and various drive components that are not inexpensive, and any additional utilization is desirable. Being able to utilize the snow blower to sweep lawns and remove debris widens the usages that can be made of the blower.

DESCRIPTION OF THE PREFERRED EMBODIMENT

Figure 1:
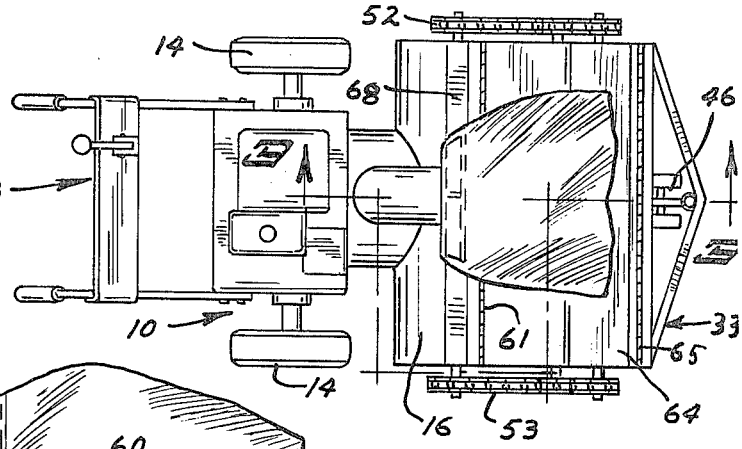
FIG. 1 is a top plan view of a typical snow blower having an attachment made according to the present invention installed thereon.
Figure 2:
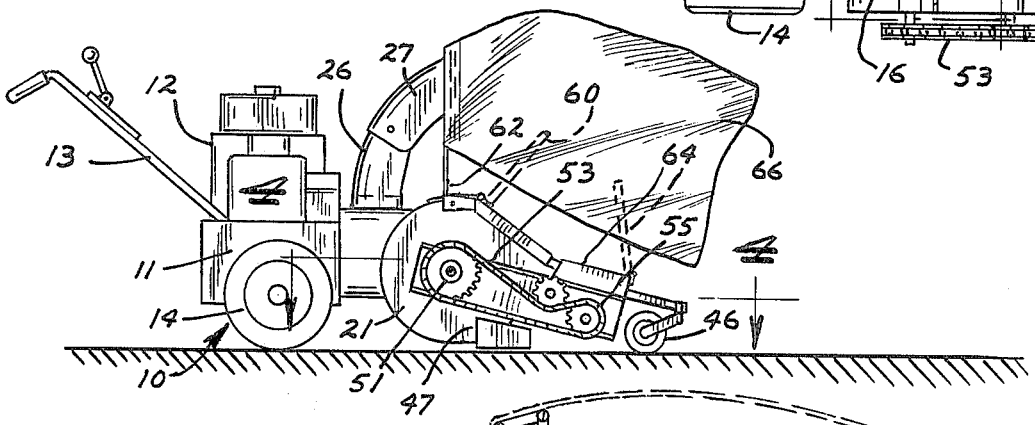
FIG. 2 is a side elevational view of FIG. 1, the closure members being shown in an open position in dotted lines.

The snow blower illustrated generally at 10, as shown, has a main frame or housing 11, a power source comprising an internal combustion engine illustrated schematically at 12, operator control handles 13, and support and drive wheels 14 which are driven through suitable transmission mechanism (not shown) in a conventional manner from the power source. The power source 12 also is used to drive a power shaft 15, which is suitably mounted in the frame 11, and as is well known in the snow blower art, the shaft 15 extends forwardly into a rotor housing 16 that is part of the frame of the snow blower, and drives a gear box 17. The gear box 17 is a right angle gear box driving a cross shaft 20 that is rotatably mounted in side walls 21 and 22, respectively of the rotor housing, and which shaft 20 comprises the rotor shaft. A plurality of rotor blades 23 are mounted onto the shaft in a suitable manner, and in the normal operation of the snow blower, the blades 23 are used for engaging the snow and pulling it backward into the inlet opening of the blower housing 24 in which a blower 25 is mounted. The blower 25 is mounted directly to the shaft 15, and is used for impelling material reaching the blower housing 24 up to a discharge chute 26, that is mounted for rotation about a vertical axis in the normal manner and includes a pivoting adjustable section 27 that provides a curved, gooseneck type discharge spout. As shown, the rotor housing has a rear wall at the lower portions thereof indicated at 30 that terminates just forwardly of the vertical transverse plane generally passing through the axis of the drive shaft 20, to provide a large opening for the rotor to engage snow.

All of the components just described are conventional in snow blowers, with slight modifications for various makes, but generally the driven rotor, blower, and discharge chute are the components that are used for moving the snow engaged by the rotor 20, 23.

The present invention relates to the adaptation and modification of the snow blower for use as a lawn sweeper. The attachment is illustrated generally at 33 and is relatively simple and comprises a pair of side plates 34 and 35, respectively, that are connected together with a front cross member 36, and a center cross member 37. The plates 34 and 35 rotatably mount a shaft 38 on which a reel type lawn rake 39 is mounted. The reel type lawn rake is known in the art, and includes spring teeth members 42 which engage the ground surface and pick up leaves and other material as the reel rotates to project the material into the rotor housing 16. The side plates 34 and 35 are fastened on the exterior of the side plates 21 and 22, respectively, with suitable fastening members (for example, nuts and bolts) that are well known in the art. In addition, the forward portions of the side plates 34 and 35 are secured to the transverse outer ends of the forwardly extending support frame members 43, the transverse inner ends of the frame members being joined with a hub 44 that in turn pivotally mounts the shaft 45 for supporting a caster wheel assembly 46.

In order to close the lower portions of the blower housing 16, a pan member 47 has its vertical side portions 47*a* secured to side 21 and 22 respectively, to extend below plates 34 and 35 (or may be joined to plates 34 and 35 to depend therefrom) and to extend forwardly of the lower portions of housing side walls 22, 23; and a transverse bottom portions 47*b* to provide a forward continuation of the lower part of the blower housing wall portion 30. Bottom portion 47*b* is at substantially the same elevation as the front terminal edge of of wall portion 30 to provide a forward continuation of said wall portion 30 at an elevation substantially below that of the axes of rotation of the rotor shaft 20 and reel shaft 38. Advantageously, the front transverse terminal edge of pan portion 47*b* is located to be substantially longitudinally forwardly of the forwardmost part of the path of rotary movement of rotor blades 23 and the rearwardmost part of the path of rotary movement of the reel fingers 43, and longitudinally rearwardly of the lowermost part of the path of rotary movement of the reel fingers.

Thus, the lower portions of the blower housing 16 are enclosed to a position ahead of the rotor to provide for a more enclosed area for transmission of material back toward the rotor itself.

Figure 3:
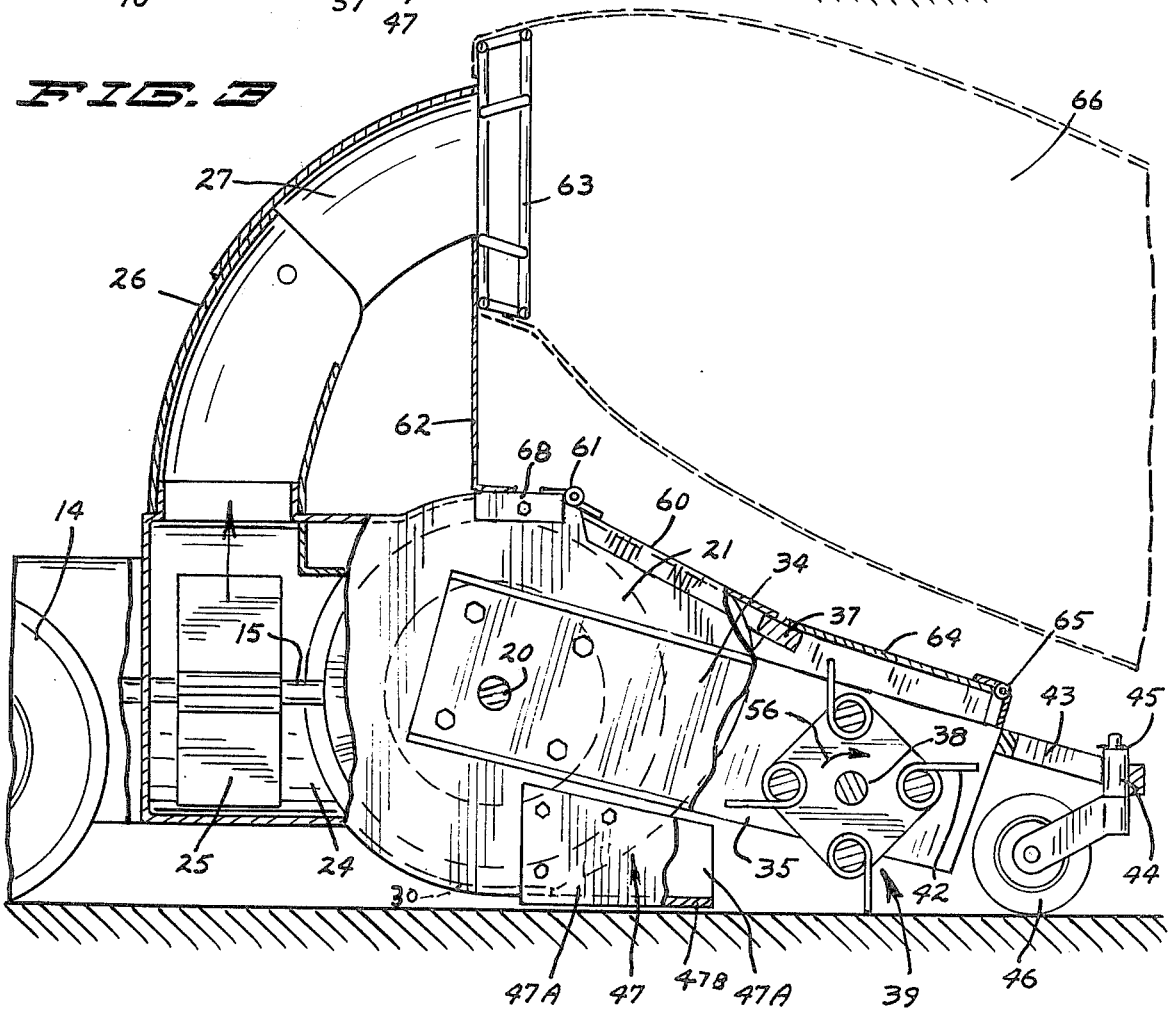
FIG. 3 is a sectional view taken generally on line 3—3 of FIG. 1 with parts in section and parts broken away.
Figure 4:
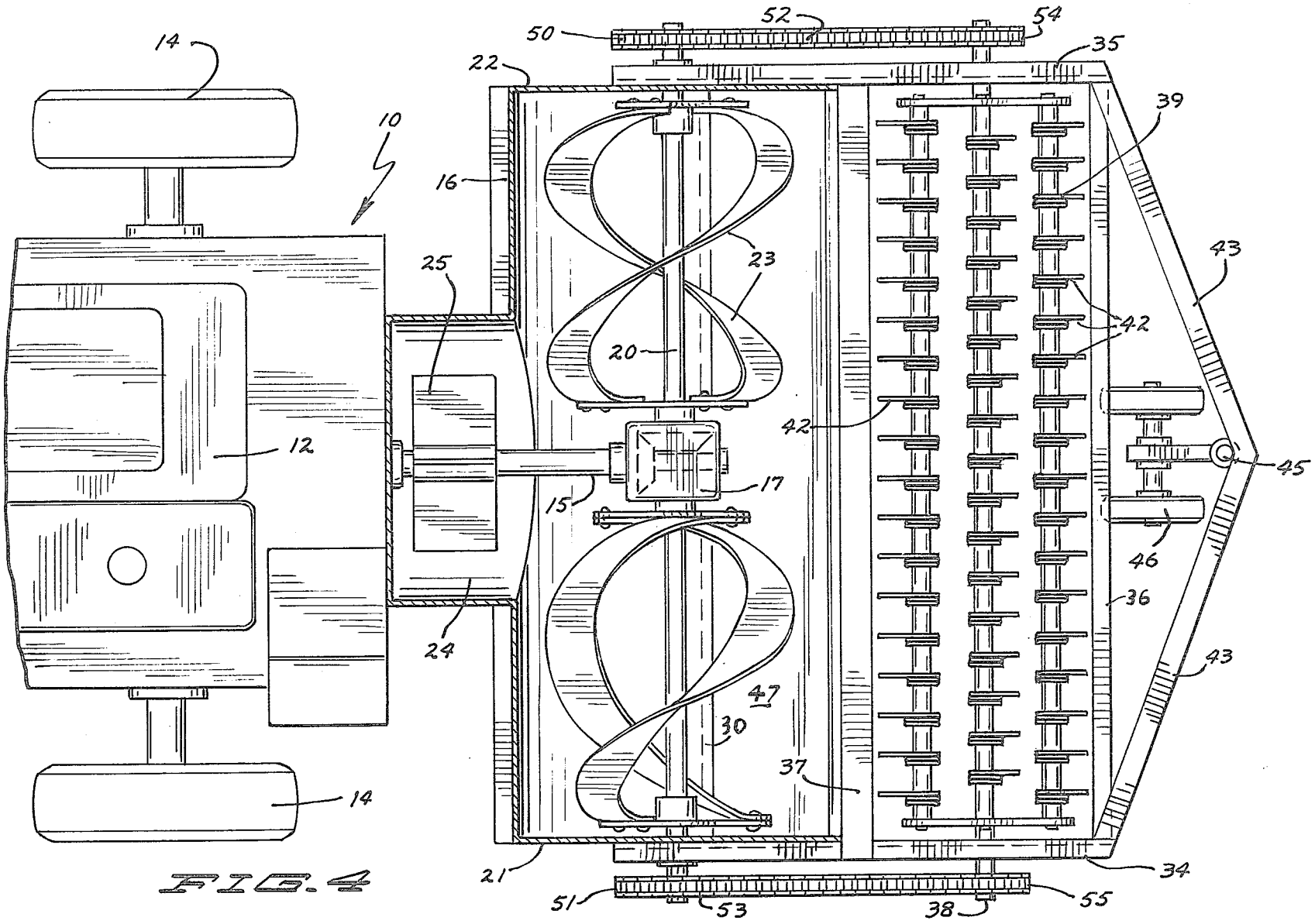
FIG. 4 is a sectional view generally along line 4—4 in FIG. 2.

The shaft 20 is provided with a pair of sprockets 50 and 51, on the opposite ends thereof which drive through chains 52 and 53 that have suitable tighteners thereon, to in turn drive sprockets 54 and 55 that are on the outwardly extending ends of the shaft 38. The chains 52 and 53 thus drive the reel 39 in the direction that is indicated by the arrow 56 in FIG. 3 whenever the rotary tool 39 is powered. Of course, at the same time the fan 25 will be driven in that it is driven from a common shaft 15, and will act to direct material moved by the reel 39 into the rotor housing and thus by the rotor and by the flow of air from the fan itself up through the discharge chute 26.

As can be seen, the upper portions of the unit 33 are closed with a first cover 60 that is hingedly connected at 61 to a bracket 68 that in turn is removably mounted to the upper wall of the rotor housing, for example, by being bolted thereto. The bracket 68 also mounts an upright support assembly 62 that supports a circular frame 63, which defines an opening aligned with the normal discharge path of material coming out through the gooseneck spout 27 and forwardly thereof. The frame 63 is used to support a bag 66 for catching materials discharged from the spout when the unit is being used as a lawn sweeper. In addition, a cover 64 is hingedly attached to the front cross member 36 as at 65, and will fold forwardly and upwardly. Since, with covers 60, 64 in a closed position, hinge 61 is attached to the rear part of cover 60, and hinge 65 is attached to the front part of cover 64, cover 60 folds upwardly and rearwardly and cover 64 folds upwardly and forwardly to expose the forward portions of the snow blower rotor and the upper portions of the reel 39 to permit cleaning, or access thereto for other reasons, as desired.

Advantageously, the maximum diameter of the reel is substantially less than the diameter of the snow blower rotor, and accordingly the axis of rotation of the reel is at a substantially lower elevation than that of the rotor. Accordingly, the covers in a closed position are inclined upwardly in a rearward direction, the adjacent edges of the covers in a closed position being supported by cross brace 37. Additionally, the covers having transversely opposite depending flanges whereby the covers in cooperation with the side plates 34, 35 and housing 34 provided a substantially closed, downwardly opening enclosure. Also, advantageously the plates 34, 35 extend forwardly of the forwardmost part of the path of rotary movement of the reel and to a substantially lower elevation than the axis of rotation of the reel.

In operation, driving the rotor will drive the reel 39 which will move the material on the ground surface back toward the rotor, and through the action of the rotor and fan 25, upwardly along the discharge spout 26, and gooseneck section 27 into the bag 64. The bag 64 is supported completely independently of the spout, on the bracket member 61, so that the bag is supported directly from the rotor housing of the snow blower.

The framework 63 permits the bag 66 to be tied in place thereon so that it is secured in position with the mouth opening toward the gooseneck section 27 and extending forwardly above the covers 60, 64.

The snow blower can be power driven so that the wheels 14 will move the unit across the lawn or ground surface doing the sweeping job as it moves. It should also be noted that if it is not desired to bag the material the spout 27 can be used to place material in an accompanying trailer or wagon if desired. The caster wheel assembly 46 makes is easy to steer, and yet provides adequate support for the reel 39 so that it does not dig into the ground excessively, and does not cause a substantial downward weight at the forward portions of the snow blower. The caster wheel 46 can support the pan 47 just off the surface of the ground, for normal use, and if desired the pan 47 can be made to be floating, that is so that it will pivot upwardly at the forward edges thereof slightly out of the way if desired to clear small obstructions.

If desired, the parts of plates 34, 35 forwardly of the pan may extend downwardly to be closely adjacent the ground.

What is claimed is:

1. For being attached to a snow blower having a normal forward direction of travel, and having a forwardly opening rotor housing that has a lower front edge portion and side walls, a power driven rotor assembly that includes a rotor extending within the housing and fan mechanism having a discharge outlet, and attachment comprising an open framework for removably mountingly supporting a bag mouth of a bag in an open condition to have material discharged into the bag, means for removably mounting the framework on the snow blower in a position to have material from the discharge outlet pass through the framework, frame members having front portions and rear portions removably attachable to the snow blower for retaining the front portions in front of the housing, rotary rake means mounted on the front portions for moving debris on a surface such as a lawn toward the rotor and into the rotor housing, means removably attachable to the rotor assembly for drivingly rotating the rake means when the rotor assembly is being driven, closure means at least in part mounted on said frame members to extend over said rake means and toward the rear portions for cooperating with the rake means to aid in directing material to the blower housing, said closure means including a closure member hingedly attached to the framework mounting means to extend toward the frame member front end portions, and a pan portion mountable on one of the frame members and the housing to extend at least in part beneath the rotor and forwardly of the housing front edge portion a substantial distance.

2. For being attached to a snow blower having a normal forward direction of travel, and having a forwardly opening rotor housing that has a lower front edge portion and side walls, a power driven rotor assembly that includes a rotor extending within the housing and fan mechanism having a discharge outlet, an attachment comprising an open framework for removably mountingly supporting a bag mouth of a bag in an open condition to have material discharged into the bag, means for removably mounting the framework on the snow blower in a position to have material from the discharge outlet pass through the framework, frame members having front portions and rear portions removably attachable to the snow blower for retaining the front portions in front of the housing, rotary rake means mounted on the front portions for moving debris on a surface such as a lawn toward the rotor and into the rotor housing, means removably attachable to the rotor assembly for drivingly rotating the rake means when the rotor assembly is being driven, closure means at least in part mounted on said frame members to extend over said rake means and toward the rear portions for cooperating with the rake means to aid in directing material to the blower housing, said frame members including longitudinally elongated, vertical side plates that are transversely spaced about the same distance as the housing side walls, the closure means having depending side flanges extending closely adjacent the side plates, and ground engaging wheel means attached to the frame member front portions for supporting the frame member front portions.

3. For being attached to a snow blower having a normal forward direction of travel, and having a forwardly opening rotor housing that has a lower front edge portion and side walls, a power driven rotor assembly that includes a rotor extending within the housing and fan mechanism having a discharge outlet, an attachment comprising an open framework adapted for removably mountingly supporting a bag including retaining the bag mouth in an open condition, an upright having an upper end portion attached to the framework, and a lower end portion, means adapted for removably securing the lower end portion to the housing to mount the upright in a position that the open framework is located to have material discharging through the discharge outlet pass through the open framework and into the bag, a second framework having front portions and rear portions removably attachable to the snow blower for retaining the front portions in front of the housing, rotary tool means mounted on the front portions for moving debris on a surface such as a lawn toward the rotor and into the rotor housing, and means removably attachable to the rotor assembly for drivingly rotating the tool means when the rotor assembly is being driven.

4. The apparatus of claim 3 further characterized in that the second framework includes a pair of transversely spaced side plates having rear portions abuttable against the snow blower side walls and front portions rotatably mounting said tool and that the attachment includes closure means extending from above said rotary tool to a location abuttable against the housing for directing material raised by the tool into the housing, said closure means including a closure member hingedly mounted on the second framework for movement between a closed position and a position extending upwardly of the closed position.

5. For being attached to a snow blower having a forwardly opening rotor housing that has a lower front edge portion and side walls, a power driven rotor assembly having a rotor extending within the housing, and fan mechanism having a discharge outlet for receiving material from the rotor housing and discharging such material, a lawn cleaning attachment comprising a framework having a rear portion mountable on the snow blower to extend forwardly of the rotor housing, and a front end portion, a rotary surface engaging tool mounted on the framework for raising debris and the like from a lawn surface and directing the raised material rearwardly, drive means detachably drivably connected to the rotor assembly for rotating said tool in a direction for moving raised material rearwardly, the framework including a pair of transversely spaced side plates having rear portions abuttable against the snow blower side walls and front portions rotatably mounting said tool, wheel means mounted on the framework front portions for supporting the framework front portions, and closure means at least in part mounted on said framework and extending over said tool to aid in directing material raised by said tool into the blower housing, said closure means including a first closure member hingedly connected to the framework for movement between a closed position and an open position to expose at least part of said tool.

6. The apparatus of claim 5 further characterized in that the closure means includes a second closure member having a transverse rear portion, means adapted for hingedly attaching the second closure member rear portion to the blower housing for movement between a closed position and a position extending upwardly and rearwardly of the first closure member closed position to expose at least part of the rotor assembly.

* * * * *

UNITED STATES PATENT AND TRADEMARK OFFICE

CERTIFICATE OF CORRECTION

PATENT NO. : 3,999,316
DATED : December 28, 1976
INVENTOR(S) : Raymond E. Palmer It is certified that error appears in the above-identified patent and that said Letters Patent are hereby corrected as shown below:

Column 2, line 39 "to" should be--into--. Column 4, line 54 (Claim 1, line 6) "and" should be--an--.

Signed and Sealed this

Fifth Day of April 1977

[SEAL]

*Attest:*

RUTH C. MASON
*Attesting Officer*

C. MARSHALL DANN
*Commissioner of Patents and Trademarks*